US010041775B2

(12) United States Patent
Caillaut et al.

(10) Patent No.: US 10,041,775 B2
(45) Date of Patent: Aug. 7, 2018

(54) SAFETY AND ARMING DEVICE FOR AN INSTANT IMPACT POINT FUSE AND FUSE INCLUDING SUCH A DEVICE

(71) Applicant: NEXTER MUNITIONS, Versailles (FR)

(72) Inventors: Nicolas Caillaut, Bourges (FR); Sylvain Jayet, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 15/217,417

(22) Filed: Jul. 22, 2016

(65) Prior Publication Data

US 2017/0138714 A1 May 18, 2017

(30) Foreign Application Priority Data

Jul. 24, 2015 (FR) ..... 15 01604

(51) Int. Cl.
*F42C 15/196* (2006.01)

(52) U.S. Cl.
CPC ..... *F42C 15/196* (2013.01)

(58) Field of Classification Search
CPC ..... F42C 15/24; F42C 15/188; F42C 15/184; F42C 15/192; F42C 15/31; F42C 15/34; F42C 15/196; F42C 15/22; F42C 15/005; F42C 15/20; F42C 15/26; F42C 15/18; F42C 15/23; F42C 1/02; F42D 1/04; H01H 35/14; F42B 30/04
USPC ..... 102/251, 226
See application file for complete search history.

(56) References Cited

U.S. PATENT DOCUMENTS 2,232,714 A * 2/1941 Mathsen ..... F42C 9/041 102/255
2,412,695 A * 12/1946 Helge ..... F42C 1/14 102/251
2,609,753 A * 9/1952 Rosenberg ..... F42C 1/08 102/246
2,715,873 A * 8/1955 Thompson ..... F42C 9/16 102/243
2,863,393 A * 12/1958 Sheeley ..... F42C 15/24 102/249

(Continued)

FOREIGN PATENT DOCUMENTS

EP 0566469 10/1993
EP 0724132 7/1996

(Continued)

*Primary Examiner* — Troy Chambers
*Assistant Examiner* — Bridget Cochran
(74) *Attorney, Agent, or Firm* — Hauptman Ham, LLP

(57) ABSTRACT

A safety and arming device for an instant impact point fuse for a gyratory projectile and a fuse equipped with such a device. The device includes a rotor carrying a primer held in a safe, non-aligned position with respect to a striker by a sleeve pressed against a flat spot of the rotor. The device also includes a flyweight that, when subjected to the longitudinal acceleration resulting from the shot, exerts a pushing force on a first end of at least one lever, the second end of the at least one lever being located below a collar of the sleeve. The pushing force of the flyweight causes the lever(s) to pivot about a pivot point, the pivoting of the lever then separates the sleeve from the flat spot of the rotor permanently, releasing the rotor.

7 Claims, 4 Drawing Sheets

(56) References Cited

U.S. PATENT DOCUMENTS 2,943,573 A * 7/1960 Graser ..... F42C 1/06 102/251
2,962,968 A * 12/1960 Neuwirth, Jr. ..... F42C 9/18 102/245
3,117,522 A * 1/1964 Hutchison ..... F42C 15/24 102/235
3,136,252 A * 6/1964 De Sabla ..... F42C 15/24 102/251
3,375,786 A * 4/1968 Marchiaro ..... F42C 1/02 102/251
3,397,640 A * 8/1968 Ziemba ..... F42C 9/06 102/243
3,410,214 A * 11/1968 Irion ..... F42C 1/06 102/251
3,595,169 A * 7/1971 Ziemba ..... F42C 15/22 102/235
3,620,163 A * 11/1971 Shekro ..... F42C 1/04 102/251
3,734,023 A * 5/1973 Kaiser ..... F42C 9/045 102/238
3,765,339 A * 10/1973 De Angelis ..... F42C 1/06 102/251
3,842,740 A * 10/1974 Mirlesse ..... F42C 14/02 102/253
3,871,297 A * 3/1975 Bayard ..... F42C 15/192 102/245
3,996,857 A * 12/1976 Padula ..... F42C 1/09 102/245
4,006,690 A * 2/1977 Stockman ..... F42C 15/196 102/236
4,040,358 A * 8/1977 Webb ..... F42C 15/22 102/242
4,237,788 A * 12/1980 Hagen ..... F42C 1/02 102/245
4,242,964 A * 1/1981 Warren ..... F42C 1/02 102/245
4,406,225 A * 9/1983 Backstein ..... F42C 9/18 102/235
4,440,085 A * 4/1984 Rossmann ..... F42C 15/196 102/235
4,458,594 A * 7/1984 Weber ..... F42C 15/192 102/235
4,480,551 A * 11/1984 Lofiego ..... F42C 1/10 102/245
4,494,459 A * 1/1985 Ziemba ..... F42C 15/196 102/235
4,510,869 A * 4/1985 Nicolas ..... F42C 15/196 102/237
4,604,953 A * 8/1986 Olander ..... F42C 1/08 102/241
4,658,725 A * 4/1987 Rudenauer ..... F42C 15/184 102/223
4,691,635 A * 9/1987 Winterhalter ..... F42C 15/192 102/235
4,942,816 A * 7/1990 Bankel ..... F42C 15/22 102/235
5,081,929 A * 1/1992 Mertens ..... F42C 1/06 102/246
5,243,912 A * 9/1993 Ziemba ..... F42C 15/192 102/235
5,355,801 A * 10/1994 Donahue ..... F42C 15/196 102/233
6,314,887 B1 * 11/2001 Robinson ..... F42C 19/06 102/262
6,964,231 B1 * 11/2005 Robinson ..... F42C 15/26 102/231
7,258,068 B2 * 8/2007 Worthington ..... F42C 15/188 102/226
7,353,755 B2 * 4/2008 Aumasson ..... F42B 39/20 102/481
7,357,081 B2 * 4/2008 Zinell ..... F42C 15/192 102/237
7,360,486 B2 * 4/2008 Alculumbre ..... F42C 15/188 102/244
7,600,475 B1 * 10/2009 Friedberg ..... F42C 9/14 102/215
8,151,709 B1 * 4/2012 Schwartz ..... F42C 15/22 102/239
2004/0144279 A1 * 7/2004 Glatthaar ..... F42C 15/31 102/221
2006/0027126 A1 * 2/2006 Aumasson ..... F42C 19/02 102/481

FOREIGN PATENT DOCUMENTS

EP 0566469 B1 * 11/1996 ..... F42C 15/192
EP 2383538 11/2011
FR 2537265 6/1984
GB 1384857 A * 2/1975 ..... F42C 9/18

* cited by examiner

SAFETY AND ARMING DEVICE FOR AN INSTANT IMPACT POINT FUSE AND FUSE INCLUDING SUCH A DEVICE

TECHNICAL FIELD OF THE INVENTION

The technical field of the invention is that of safety and arming devices for a fuse intended to equip a gyratory projectile.

STATE OF PRIOR TECHNOLOGY

A fuse of a projectile conventionally includes a safety and arming device which is intended to avoid any untimely operation of the primer which it includes or of the projectile to which this fuse is attached.

To this end, there exist devices preventing alignment of the primer with a strike of the fuse. Thus patent EP566469 describes a safety device including a primer-carrying rotor held out of alignment by a sleeve. The sleeve blocks the rotor in a non-aligned position by supporting itself on a flat spot of the rotor. The sleeve releases the rotor by moving away by inertia as a result of the shot. Such a device is suited to munitions of medium caliber and is located on the rear portion of the projectile at the base.

Such a device is not suited to instant impact point fuses which include a striker which is projected on impact onto a target in the direction of the rear of the projectile.

Moreover, the STANAG 4187 standardization agreement published by NATO, requires that the fuses of the projectile include a double safety. Thus the invention makes it possible to add a second safety device to an instant impact point fuse already including a first safety device using a rotor such as that described in patent FR2533686.

The invention also aims to resolve a problem with integration of safety devices for a fuse having a configuration of a striker projected to the rear upon impact.

PRESENTATION OF THE INVENTION

Thus, the invention applies to a safety and arming device for an instant impact point fuse designed for a gyratory projectile, a device including a rotor carrying a primer held in a safe, non-aligned position with respect to a striker by a sleeve pressed against a flat spot of the rotor by a spring, a device characterized in that it includes a flyweight intended, when it is subjected to the longitudinal acceleration resulting from the shot, to exert a pushing force on a first end of at least one lever, the second end of the at least one lever being located below a collar of the sleeve, the pushing force of the flyweight causing the lever(s) to pivot about a pivot point located between the two ends of the lever, the pivoting of the lever(s) separating the sleeve from the flat spot of the rotor permanently to release the rotation of the latter.

Advantageously, the device includes at least two levers regularly distributed angularly around the sleeve.

The levers can consist of tabs secured to a washer at their first end, tabs that are can deform plastically at their junction with the washer.

The flyweight can be annular and can exert its pushing force at the washer.

The flyweight can also include a blocking means at the end-of-travel position when the levers have separated the sleeve from the rotor.

The sleeve can include a recess receiving the second end of the levers when the sleeve is pressed against the flat spot, so as to secure in translation the sleeve and the levers in the safe position of the device.

The invention also relates to an instant impact point fuse for a gyratory projectile including such a safety device.

BRIEF DESCRIPTION OF THE FIGURES

The invention will be better understood upon reading the following description, illustrated by the appended drawings wherein.

DETAILED DESCRIPTION OF DIFFERENT EMBODIMENTS OF THE INVENTION

Figure 1:
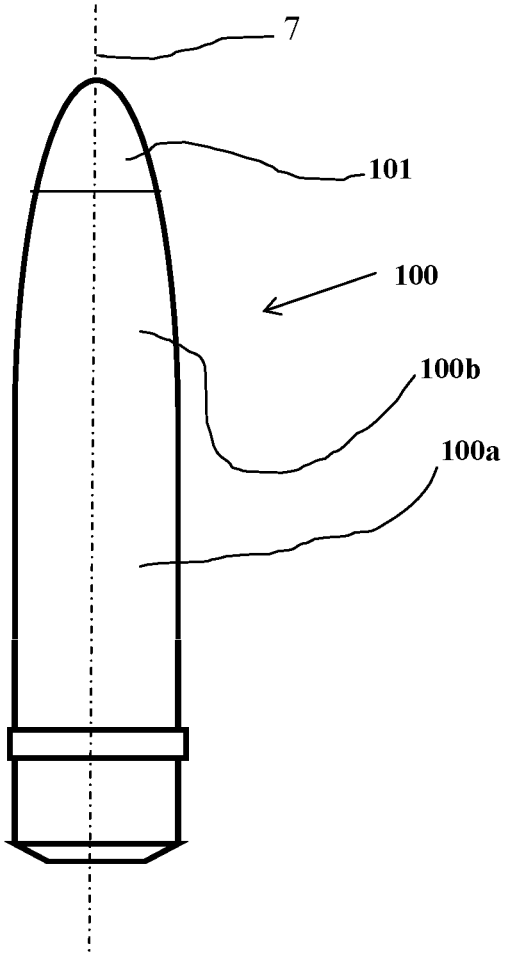
FIG. 1 shows an overall view of a projectile including a safety device according to the invention.

According to FIG. 1, a medium-caliber projectile 100 (that is with a caliber comprised between 12.7 mm and 75 mm) includes a projectile body 100*a*, which has a tapered portion 100*b* and a fuse 101 attached at the front point of the projectile 100 (a so-called instant impact point fuse).

This projectile 100 is stabilized on its trajectory thanks to a rotary movement about its longitudinal axis 7, a movement imparted to the projectile by means of riflings in the barrel of a weapon (weapon not shown). The fuse 101 has the function of ensuring the triggering of a useful charge carried in the projectile body 100*a* such as an explosive for example. As we will see later, the fuse 101 includes a safety and arming device intended to prevent the fuse from triggering the charge inappropriately other than during a phase of firing the projectile.

This device contains a primer which is held in a non-aligned position by at least two locking means which are released by different environmental effects, one locking means released by the axial acceleration of the shot and the other released by the centrifugal acceleration resulting from the shot.

Figure 2:
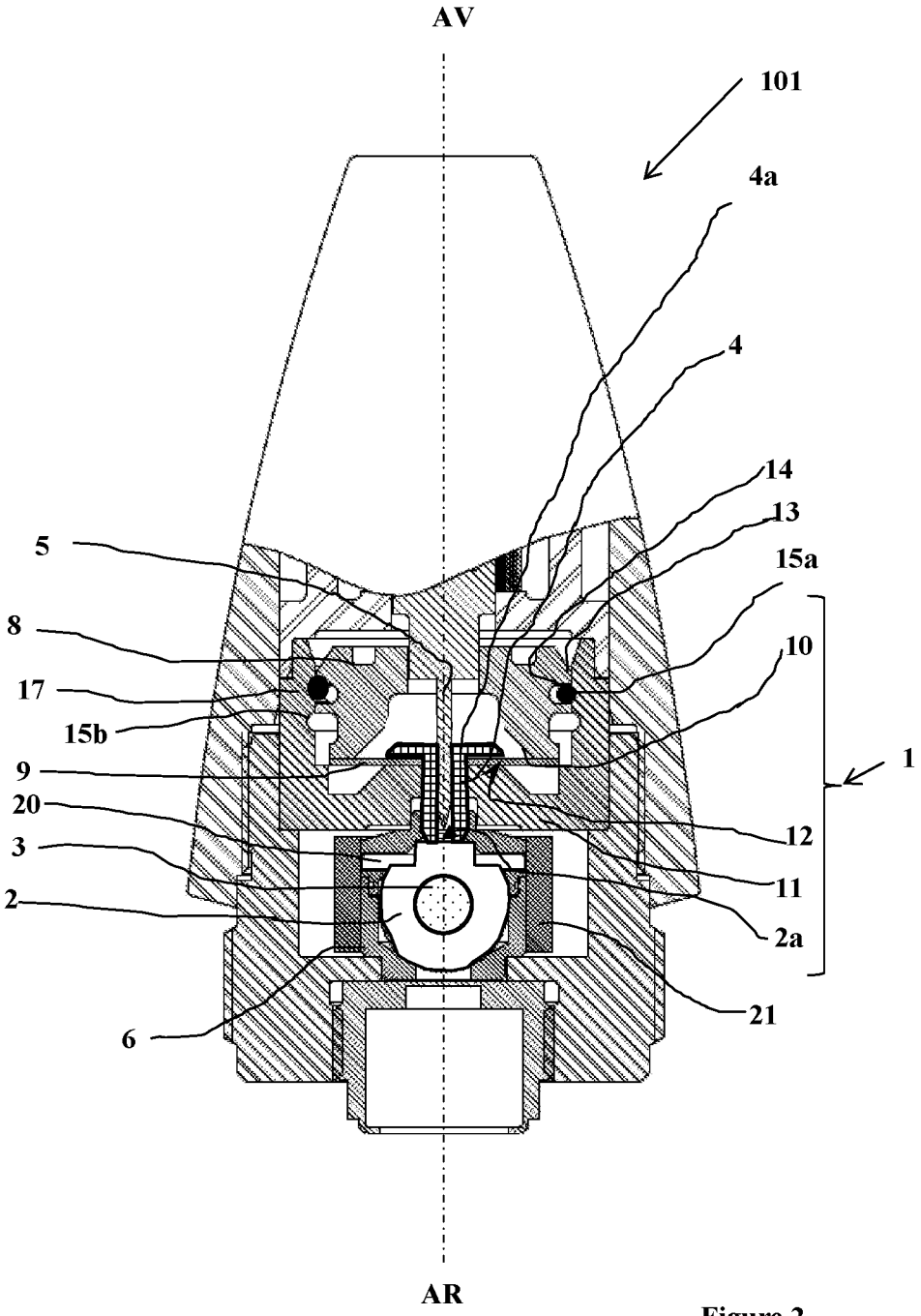
FIG. 2 shows a longitudinal section view of a fuse including a safety device according to the invention in the safe position.

According to FIG. 2, the fuse 101 includes a safety device 1 including a rotor 2 bearing a primer 3. The rotor 2 is substantially spherical and positioned in a cage 6 and the primer 3 is positioned transversely to the longitudinal axis 7 of the fuse 101. The cage 6 is mounted so as to turn with respect to the axis 7. The rotor includes a flat spot 2*a* serving as a support face to the end of a sleeve 4. The sleeve 4 is drilled longitudinally so as to allow the passage of a striker 5 which is intended to strike the primer 3 when it is aligned with the striker 5 following impact on a target.

So as to prevent the alignment of the rotor 2 other than under operational use conditions, two safeties are installed.

The first safety, described in patent EP105001, consists of unlocking the rotor 2 only during centrifugal separation comparable to that induced by driving the projectile into motion about its longitudinal axis when it is actually fired. For this purpose, radial pins 20 positioned in radial drillings of the cage 6 block the rotor 2. They are removed from the rotor 2 after the unrolling of a spiral 21 which delays their removal so that the un-blocking of the rotor 2 occurs only once the projectile has left the barrel of the weapon.

The second safety is contributed by the sleeve 4. By supporting itself on the flat spot 2*a*, the sleeve 4 contributes to preventing the rotor 2 from turning. In this manner, the safety device 1 also holds the rotor 2 bearing the primer 3 in a safe position, the primer 3 not aligned with the striker 5.

It will be noted that the sleeve 4 includes a collar 4*a* at its second end oriented toward the front AV of the fuse 101. The sleeve 4 passes through a washer 9 and is supported by a central portion of the washer 9 on its lower face oriented toward the rear AR of the fuse 101.

The face of the washer 9 oriented toward the front AV of the fuse 101 supports, in proximity to its outer edge, an annular flyweight 8.

Figure 3:
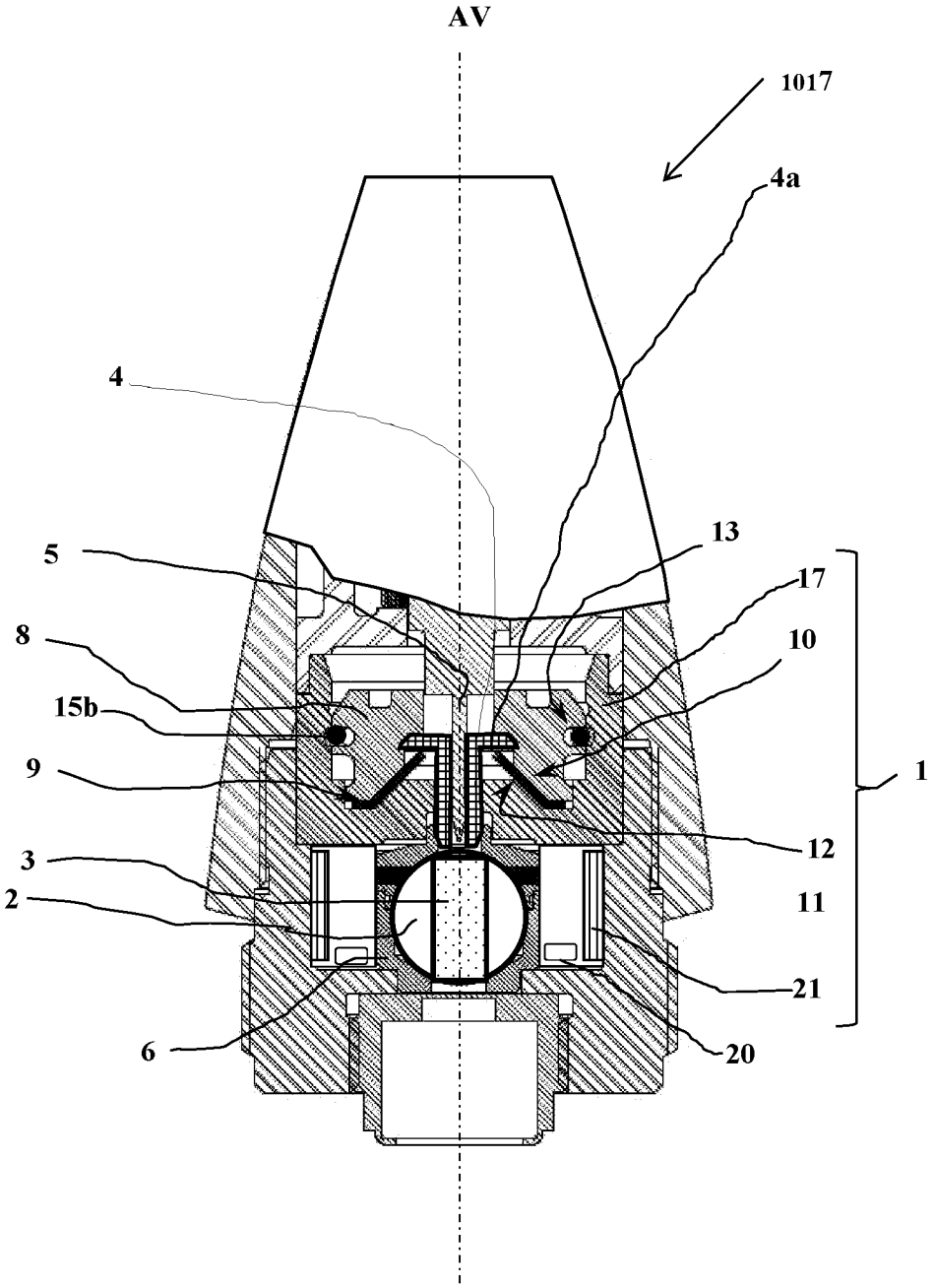
FIG. 3 shows a longitudinal section view of a fuse including a safety device according to the invention in the armed position.
Figure 4:
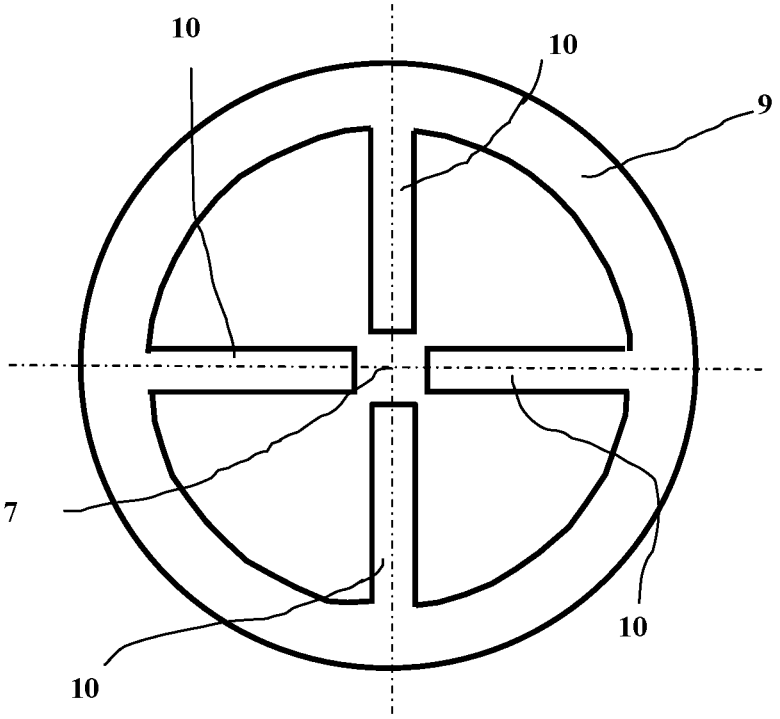
FIG. 4 shows a top view of a washer implemented in the device according to the invention.

As can be seen in FIG. 4, the washer 9 includes radial tabs 10 regularly distributed angularly and extending toward the centre of the washer 9. These tabs 10 constitute the levers 10 of which the first ends are secured to the washer 9 and the second ends are disconnected one from the others and are located under the lower face of the collar 4*a* of the sleeve 4 visible in FIGS. 2, 3 and 5.

Figure 5:
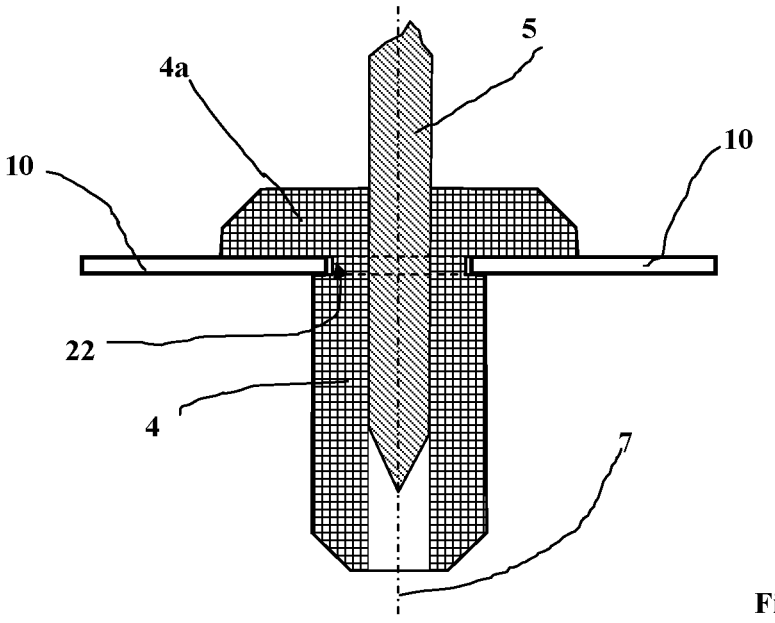
FIG. 5 shows a detail view in longitudinal section of the fuse of FIG. 2 at its sleeve.

It can be seen in FIG. 5 that the second end of the tabs 10 is placed in a recess 22 of the sleeve 4 so as to secure in translation the sleeve 4 relative to the second ends of the levers 10. Thus, the sleeve 4 will not leave its safe position accidentally during handling of the fuse 101 and will remain resting on the flat spot 2*a* of the rotor 2 in the safe position.

The device 1 includes a centring ring 11 intended to ensure the linear guidance of the sleeve 4 along the longitudinal axis 7 of the device 1. The edge of the centring ring 11 located under levers 10 and between the first and the second end of each lever 10 is a circular zone on which each lever is resting at a tipping point 12, allowing each lever 10 to be pivoted around this point 12 depending on the action applied to the ends of the levers 10.

In the safe position such as in FIG. 2, the levers 10 have their first end cantilevered with respect to their tipping point 12.

It will be noted that in the safe position, the second end of the levers 10 is trapped between the bottom of the collar 4*a* and the centring ring 11. The flyweight 8 is able to translate longitudinally but it is held in position by an elastic O-ring 13 located over a portion of its section in a recess 14 of the flyweight 8 and for a portion in a first slot 15*a* carried by a cylindrical extension 17 of the ring 11 and located facing the recess 14.

According to FIG. 3, when the projectile is fired, the violent acceleration undergone by the fuse 101 imposes by inertia a backward movement of the flyweight 8 toward the rear AR of the device along the longitudinal axis 7.

In doing this, the O-ring 13 is swaged in the recess 14 by the translation action of the flyweight 8 and the compression exerted by the inner walls of the cylindrical extension 17 of the ring 11. The flyweight 8 exerts a pushing force on the washer 9 at the second ends of the levers 10. The levers 10 carry out a rotation around their tipping points 12, thus producing a lever arm effect which causes a movement of the first end of the levers toward the front AV of the device 1.

While rising, the first ends of the levers lift the sleeve 4 by means of its collar 4*a* and translate it axially through the centring ring 11. The sleeve 4 is then no longer supported on the flat spot of the rotor, which can then turn to align the primer 3 with the striker 5, when the centrifugal locking pins 20 have been ejected.

It is obvious to a person skilled in the art that the number of levers is not limiting, just as a single lever could suffice. But the positioning of several levers regularly distributed ensures a more reliable operation.

The washer 9 and its levers will be made in a material that is plastically deformable under the pushing force from the flyweight 8 so as to prevent the levers and especially the sleeve from returning to their original position once the projectile is fired.

Still with the purpose of preventing the return to the safe position of the sleeve 4, the inner wall of the extension 17 of the ring 11 can include a second indentation 15*b* intended to allow the expansion of the O-ring 13. The indentation 15*b* and the O-ring 13 thus form a blocking means of the flyweight 8 in its end-of-travel position.

It will be noted that the outer portion of the washer 9 has the function of ensuring the connection between the levers 10, but is not indispensable. One could in fact position each lever individually and pivotally with respect to the ring 11.

The invention claimed is:

1. A safety and arming device for an instant impact point fuse designed for a gyratory projectile, the device including a rotor carrying a primer held in a safe, non-aligned position with respect to a striker by a sleeve pressed against a flat spot of the rotor, wherein the device includes a flyweight, when it is subjected to a longitudinal acceleration resulting from a shot, configured to exert a pushing force on a first end of at least one lever, a second end of the at least one lever being located below a collar of the sleeve, pushing force of the flyweight causing the lever(s) to pivot about a pivot point located between the two ends of the lever with the pivoting of the lever(s) separating the sleeve from the flat spot of the rotor permanently to release the rotation of the latter.

2. The safety device according to claim 1, the device further includes at least two levers regularly distributed angularly around the sleeve.

3. The safety device according to claim 2, wherein the levers consist of tabs secured to a washer at their first end, the tabs being plastically deformable at their junction with the washer.

4. The safety device according to claim 3, wherein the flyweight is annular and exerts its pushing force at the washer.

5. The safety device according to claim 1, wherein the flyweight includes blocking means at end-of-course position when the levers have separated the sleeve from the rotor.

6. The safety device according to claim 1, wherein the sleeve includes a recess receiving the second end of the levers when the sleeve is pressed against the flat spot so as to secure in translation the sleeve and the levers in the safe position of the device.

7. An instant impact point fuse for a gyratory projectile including a safety device according to claim 1.

* * * * *